US007642880B2

(12) United States Patent
Breiter et al.

(10) Patent No.: US 7,642,880 B2
(45) Date of Patent: Jan. 5, 2010

(54) SWITCH ARRANGEMENT

(75) Inventors: Richard Breiter, Frederiksberg C (DK); Erik Bengtsson, Esløv (SE)

(73) Assignee: Nokia Corporation, Espoo (FI)

( * ) Notice: Subject to any disclaimer, the term of this patent is extended or adjusted under 35 U.S.C. 154(b) by 87 days.

(21) Appl. No.: 11/823,994

(22) Filed: Jun. 29, 2007

(65) Prior Publication Data

US 2009/0002259 A1 Jan. 1, 2009

(51) Int. Cl.
*H01P 1/10* (2006.01)
*H01P 1/15* (2006.01)

(52) U.S. Cl. ..... 333/103; 333/262

(58) Field of Classification Search ..... 333/101, 333/103, 104, 105, 107, 262
See application file for complete search history.

(56) References Cited

U.S. PATENT DOCUMENTS

| | | | | |
|---|---|---|---|---|
| 5,594,394 | A | 1/1997 | Sasaki et al. | 333/103 |
| 6,281,762 | B1 * | 8/2001 | Nakao et al. | 333/103 |
| 6,496,083 | B1 | 12/2002 | Kushitani et al. | 333/103 |
| 6,693,498 | B1 * | 2/2004 | Sasabata et al. | 333/103 |
| 6,744,334 | B1 * | 6/2004 | Marumoto | 333/156 |
| 7,057,472 | B2 * | 6/2006 | Fukamachi et al. | 333/101 |
| 7,391,283 | B2 * | 6/2008 | Kearns | 333/103 |
| 2006/0141944 | A1 | 6/2006 | Shibagaki et al. | 455/78 |

FOREIGN PATENT DOCUMENTS

WO WO-03/096474 A1 11/2003

OTHER PUBLICATIONS

"A PIN Diode Switch Operating at Multi-Frequency Bands", Shingo Tanaka, et al., IEEE MTT-S Digest, 2004, pp. 1129-1132.
"Design and Fabrication of Multiband p-i-n Diode Switches With Ladder Circuits", Shingo Tanaka et al., IEEE Transactions On Microwave Theory And Techniques, 2006, pp. 1-8.
"77 GHz Monolithic MMMIC Schottky and PIN Diode Switches Based on GaAs MESFET and Silicon SIMMWIC Technology", A. Klaassan et al., IEEE MTT-S Diget, 1995, pp. 1631-1634.
"High Linearity SPDT Switch for Dual Band Wireless LAN Applications", Kang-Ho Lee et al., APMC 2005 Proceedings, IEEE 2005, 4 pgs.

* cited by examiner

*Primary Examiner*—Dean O Takaoka
(74) *Attorney, Agent, or Firm*—Harrington & Smith, PC

(57) ABSTRACT

A single pole N throw (SPNT) switch arrangement including: a pole, one or more throw nodes and a switch mechanism arranged to connect the pole and a first throw node in response to a first signal and to disconnect the pole and the first throw node in response to a second signal; an interconnect, for providing the first signal, arranged for connection to the pole when providing the first signal; and a dc power source arranged to control a dc bias applied to the interconnect to provide the first signal

30 Claims, 5 Drawing Sheets

SWITCH ARRANGEMENT

FIELD OF THE INVENTION

Embodiments of the present invention relate to an RF switch arrangement. Some embodiments relate to a single pole N throw switch arrangement.

BACKGROUND TO THE INVENTION

It may sometimes be necessary to use a switch for radio frequency signals. It may, for example, be desirable to use a switch to select which one of multiple different feeds should be electrically connected to an antenna.

It would be desirable to provide a switch for radio frequency signals that has good performance.

BRIEF DESCRIPTION OF VARIOUS EMBODIMENTS OF THE INVENTION

According to various embodiments of the invention there is provided a single pole N throw (SPNT) switch arrangement comprising: a pole, one or more throw nodes and a switch mechanism arranged to connect the pole and a first throw node in response to a first signal and to disconnect the pole and the first throw node in response to a second signal; an interconnect, for providing the first signal, arranged for connection to the pole when providing the first signal; and a dc power source arranged to control a dc bias applied to the interconnect to provide the first signal.

According to various embodiments of the invention there is provided an apparatus comprising: an antenna arrangement; a dc bias source for providing a dc bias signal; RF circuitry for providing an RF signal; and a switch arrangement comprising: a pole connected to the dc bias source and the RF circuitry, a first throw node connected to the antenna arrangement and a transistor arranged to have a channel connecting the pole and the first throw node and a gate connected to receive the dc bias signal, wherein the transistor channel is arranged to provide the RF signal to the antenna arrangement when a dc bias signal is provided by the dc bias source.

According to various embodiments of the invention there is provided a method comprising: combining an RF signal and a dc signal; providing a combination of an RF signal and a dc signal at a transistor switch having at least a pole for receiving an input signal, a control node for receiving a switch actuation signal and a throw node for providing an output signal; providing at least the dc component of the combined signal to the control node as a switch actuation signal; and filtering the combined signal at the pole or throw node to remove the dc signal.

BRIEF DESCRIPTION OF THE DRAWINGS

For a better understanding of various embodiments of the present invention reference will now be made by way of example only to the accompanying drawings in which.

DETAILED DESCRIPTION OF VARIOUS EMBODIMENTS OF THE INVENTION

Figure 1A:
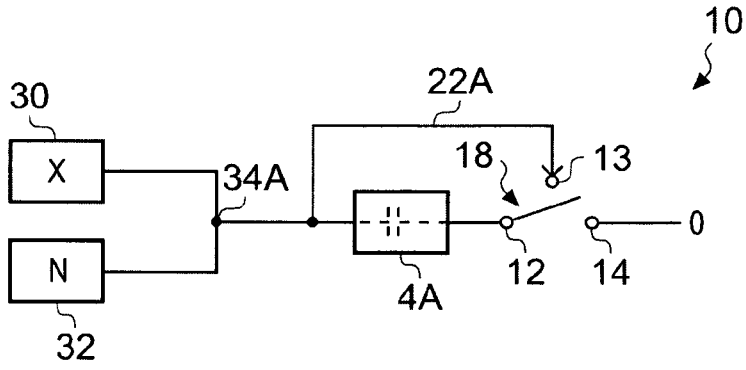
FIG. 1A illustrates one possible implementation of a single pole single throw switch arrangement.

FIGS. 1, 2 and 4 schematically illustrate single pole N throw (SPNT) switch arrangements 10. A single pole N throw switch is a switch with a single pole and one or more throw nodes.

A SPNT switch arrangement 10 comprises a single pole 12, a first throw node 14 and a switch mechanism 18 arranged to connect the pole 12 and the first throw node 14 in response to a first signal and to disconnect the pole 12 and the first throw node 14 in response to a second signal.

The term 'switch mechanism' includes mechanical, electrical, electro-mechanical, electronic, photonic and other components or devices that are used for switching. The term 'transistor switch element' defines a switch mechanism that uses a transistor as a switching element. The term 'transconductance switch element' defines a switch mechanism that uses a voltage controlled transconductance device such as a field effect transistor as the switching element. For example, one or more Gallium Arsenide (GaAs) field effect transistors may be used in the switch mechanism. Such transistors are linear switches with low current consumption.

FIG. 1A schematically illustrates a single pole N throw (SPNT) switch arrangement 10. In this example, N=1, and the SPNT switch is a single pole single throw (SPST) switch.

A power source 30 provides the first/second signals to a control node 13 of the SPNT switch arrangement 10 via an interconnect 22A that is connected between the pole 12 and the control node 13. The interconnect 22A provides a signal received as an input to the switch 10 as the first/second signal. A dc bias may be added to the input signal by the power source 30 for actuating the switch 10.

The power source 30 provides the first signal as a first dc bias and the second signal as a second dc bias. For example, the first signal may be the presence of a dc offset (the offset may be positive or negative e.g. 2.5V or −2.5V) and the second signal may be the absence of the dc offset (e.g. 0V). Alternatively, the first signal may be the absence of a dc offset and the second signal may be the presence of the dc offset X.

The output of the power source 30 is provided to a node 34A that is also fed by RF circuitry 32. The node 34A is also connected to the interconnect 22A and, through a filter 4A, to the pole 12.

The filter 4A may be, for example a capacitor. The capacitor 4A removes any dc bias so that only the RF signal is received at the pole 12.

Figure 1B:
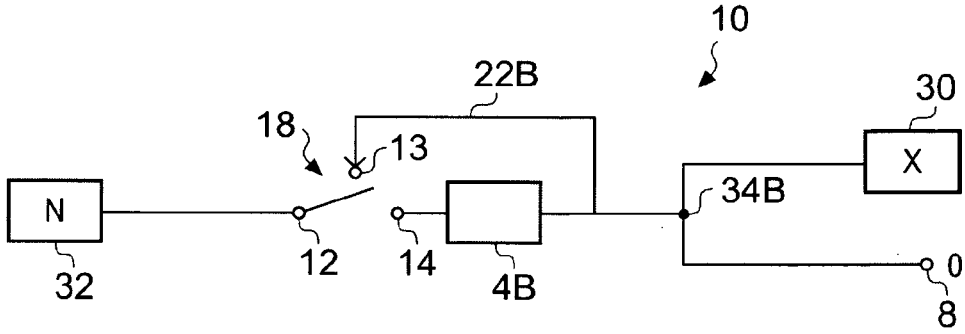
FIG. 1B illustrates another possible implementation of a single pole single throw switch arrangement.

FIG. 1B schematically illustrates another different single pole single throw (SPST) switch arrangement 10.

A power source 30 provides the first/second signals to a control node 13 of the SPNT switch 10 via an interconnect 22B that is connected between the throw node 14 and the control node 13.

The power source 30 provides the first signal as a first dc bias and the second signal as a second dc bias. For example, the first signal may be the presence of a dc offset (the offset may be positive or negative e.g. 2.5V or −2.5V) and the second signal may be the absence of the dc offset (e.g. 0V). Alternatively, the first signal may be the absence of a dc and the second signal may be the presence of the dc offset X.

The output of the power source 30 is provided to a node 34B that is also connected to an output node 8 of the switch arrangement 10. The node 34B is also connected to the interconnect 22B and, through a filter 4B, to the throw node 14.

The filter 4B may be, for example a capacitor. A capacitor removes any dc bias provided by the power source 30.

Figure 2A:
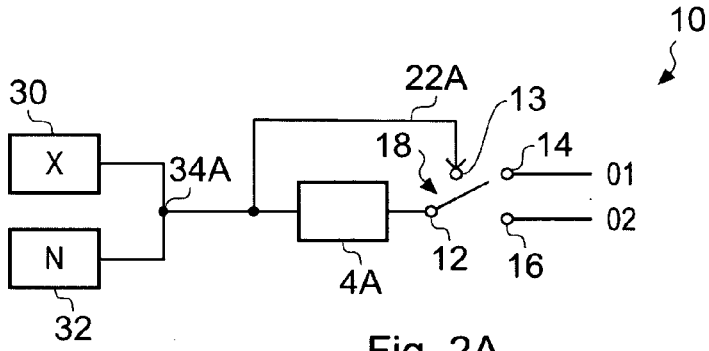
FIG. 2A illustrates one possible implementation of a single pole double throw switch arrangement.

FIG. 2A schematically illustrates a single pole N throw (SPNT) switch arrangement 10. In this example, N=2, and the SPNT switch is a single pole double throw (SPDT) switch.

A SPDT switch 10 comprises a single pole 12, a first throw node 14, a second throw node 16 and a switch mechanism 18 arranged to connect the pole 12 and the first throw node 14 in response to a first signal and to disconnect the pole 12 and the first throw node 14 and connect the pole 12 and the second throw node 16 in response to a second signal.

A power source 30 provides the first/second signals to a control node 13 of the SPDT switch 10 via an interconnect 22A that is connected between the pole 12 and the control node 13. The interconnect 22A provides a signal received as an input to the switch 10 as the first/second signal. A dc bias may be added to the input signal by the power source for actuating the switch arrangement 10.

The power source 30 provides the first signal as a first dc bias and the second signal as a second dc bias. For example, the first signal may be the presence of a dc offset (the offset may be positive or negative e.g. 2.5V or −2.5V) and the second signal may be the absence of the dc offset (e.g. 0V). Alternatively, the first signal may be the absence of a dc offset and the second signal may be the presence of the dc offset X.

The output of the power source 30 is provided to a node 34A that is also fed by RF circuitry 32. The node 34A is also connected to the interconnect 22A and, through a filter 4A, to the pole 12.

The filter 4A may be, for example a capacitor. The capacitor 4A removes any dc bias so that only the RF signal is received at the pole 12.

Figure 2B:
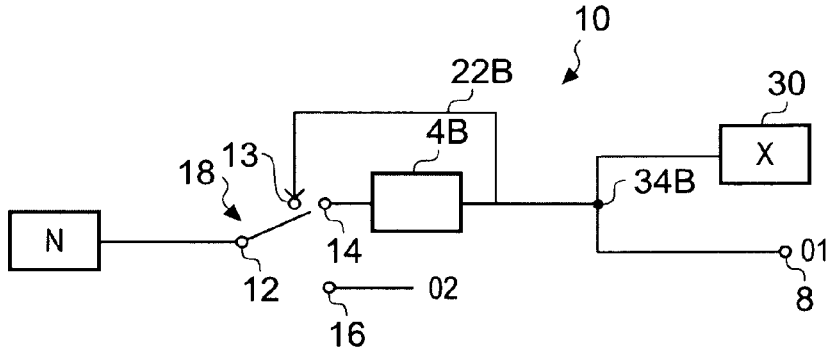
FIG. 2B illustrates another possible implementation of a single pole double throw switch arrangement.

FIG. 2B schematically illustrates another single pole double throw (SPDT) switch arrangement 10.

The SPDT switch arrangement 10 comprises a single pole 12, a first throw node 14, a second throw node 16 and a switch mechanism 18 arranged to connect the pole 12 and the first throw node 14 in response to a first signal and to disconnect the pole 12 and the first throw node 14 and connect the pole 12 and the second throw node 16 in response to a second signal.

A power source 30 provides the first/second signals to a control node 13 of the SPDT switch arrangement 10 via an interconnect 22B that is connected between the one of the first or second throw nodes and the control node 13. In the illustrated example, the interconnect 22B is connected between the first throw node 14 and the control node 13.

The power source 30 provides the first signal as a first dc bias and the second signal as a second dc bias. For example, the first signal may be the presence of a dc offset (the offset may be positive or negative e.g. 2.5V or −2.5V) and the second signal may be the absence of the dc offset (e.g. 0V. Alternatively, the first signal may be the absence of a dc offset and the second signal may be the presence of the dc offset X.

The output of the power source 30 is provided to a node 34B that is also connected to an output node 8 of the switch 10. The node 34B is also connected to the interconnect 22B and, through a filter 4B, to the first throw node 14.

The filters 4B may be, for example a capacitor. A capacitor removes any dc bias added by the power source 30.

Figure 2C:
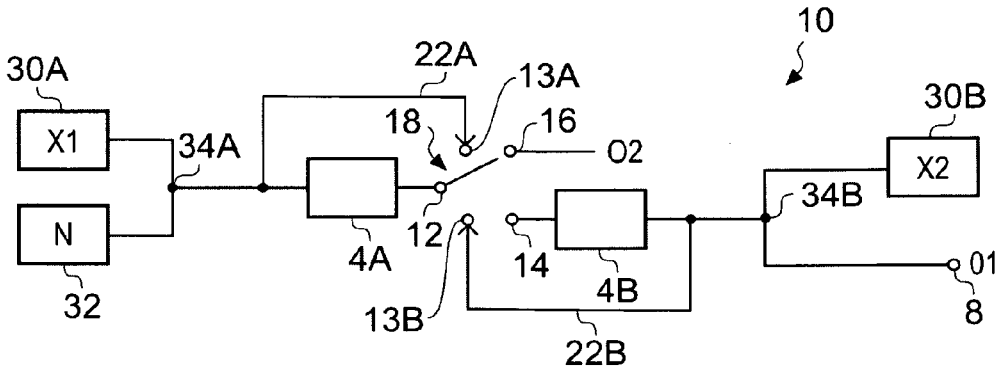
FIG. 2C illustrates another possible implementation of a single pole double throw switch arrangement.

FIG. 2C schematically illustrates another example of a single pole double throw (SPDT) switch arrangement 10.

The SPDT switch 10 comprises a single pole 12, a first throw node 14, a second throw node 16 and a switch mechanism 18 arranged to connect the pole 12 and the first throw node 14 in response to a first signal and to disconnect the pole 12 and the first throw node 14 and connect the pole 12 and the second throw node 16 in response to a second signal.

A first power source 30A provides the first signal to a first control node 13A of the SPDT switch 10 via a first interconnect 22A that is connected between the pole 12 and the first control node 13A. The interconnect 22A enables a signal received as an input to the switch 10 to be used as the first signal. A dc bias may be added to the input signal by the first power source 30A for actuating the switch 10.

The first power source 30A provides the first signal as a first dc bias. For example, the first signal may be the presence of a dc offset (the offset may be positive or negative e.g. 2.5V or −2.5V). Alternatively, the first signal may be the absence of a dc offset.

The output of the first power source 30A is provided to a node 34A that is also fed by RF circuitry 32. The node 34A is also connected to the interconnect 22A and, through a filter 4A, to the pole 12.

The filter 4A may be, for example a capacitor. The capacitor 4A removes any dc bias added by the first power source 30A so that only the RF signal is received at the pole 12.

A second power source 30B provides the second signal to a second control node 13B of the SPDT switch 10 via a second interconnect 22B that is connected between the one of the first or second throw nodes and the control node 13B. In the illustrated example, the interconnect 22B is connected between the first throw node 14 and the control node 13B.

The second power source 30B provides the second signal as a second dc bias. For example, the second signal may be the presence of a dc offset (the offset may be positive or negative e.g. 2.5V or −2.5V). Alternatively, the second signal may be the absence of a dc offset.

The output of the second power source 30B is provided to a node 34B that is also connected to an output node 8 of the switch arrangement 10. The node 34B is also connected to the second interconnect 22B and, through a filter 4B, to the first throw node 14.

The filters 4B may be, for example a capacitor. A capacitor removes any dc bias added by the second power source 30B.

Figure 3:
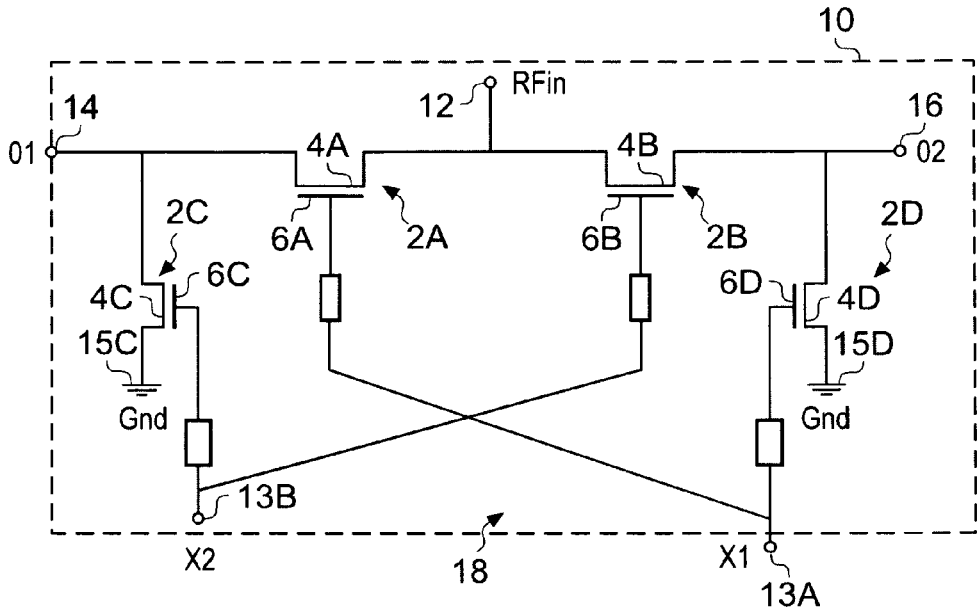
FIG. 3 illustrates one possible implementation of a single pole double throw switch.

An example of a switch mechanism 18 for use in the embodiment illustrated in FIG. 2C is illustrated in FIG. 3. In this example, the switch mechanism 18 is a transistor switch mechanism 18 comprising a plurality of field effect transistors including a first FET 2A, a second FET 2B, a third FET 2C and a fourth FET 2D.

The first FET 2A has a channel 4A connected between the single pole 12 and the first throw node 14 and a gate 6A connected to a first control node 13A for receiving the first signal X1.

The second FET 2B has a channel 4B connected between the single pole 12 and the second throw node 16 and a gate 6B connected to a second control node 1 3B for receiving the second signal X2.

The third FET 2C has a channel 4C connected between the first throw node 14 and a reference (e.g. ground) node 15C and a gate 6C connected to the second control node 13B for receiving the second signal X2.

The fourth FET 2D having a channel 4D connected between the second throw node 16 and a reference (e.g.

ground) node 15D and a gate 6b connected to the first control node 13 for receiving the first signal X1

When the first signal X1 is applied to the first control node 13, the first transistor 4A and the fourth transistor 2D are switched on i.e. their channels 4A, 4D become conductive. Consequently, the first throw node 14 is connected to the pole 12 and the second throw node 16 is connected to the reference node 15D. At the same time X2 may be zero (negative compared to X1) this turns the second transistor 4B and the third transistor 4C off.

When the second signal X2 is applied to the second control node 13B, the second transistor 4B and the third transistor 2C are switched on i.e. their channels 4B, 4C become conductive. Consequently, the second throw node 16 is connected to the pole 12 and the first throw node 16 is connected to the reference node 15C. At the same time X1 may be zero (negative compared to X2) this turns the first transistor 4A and the fourth transistor 4D off.

Figure 4A:
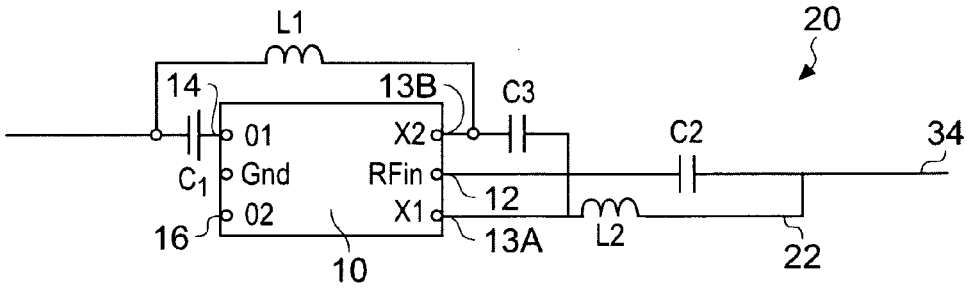
FIG. 4A schematically illustrates another single pole double throw switch arrangement.
Figure 4B:
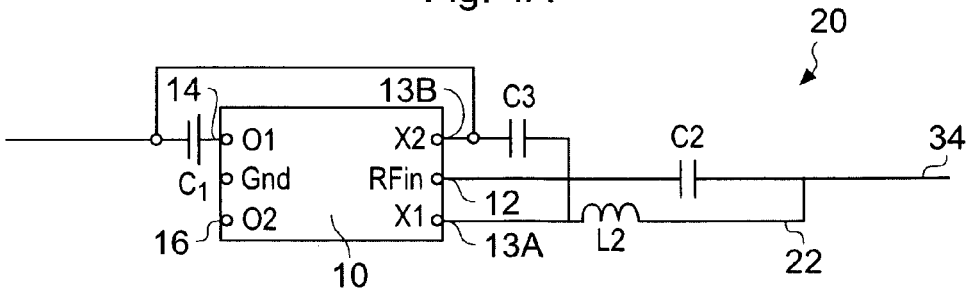
FIG. 4B schematically illustrates another single pole double throw switch arrangement.

Referring to FIGS. 4A and 4B, a SPDT switch 10 is used in arrangements as described with reference to FIG. 2C. However, only the first throw node 14 is connected to provide an output via a capacitor C1. The second throw node 16 is in open circuit.

In these Figs, the first interconnect 22A connects to first control node 13A via an inductor L2 and the second interconnect 22B connects to the second control node 13B optionally via the inductor L1.

A capacitor C3 is connected between the first and second control nodes In FIG. 4A, an inductor L1 is connected between the first throw node 14 and the second control node 11. However, in FIG. 4B, this inductor is absent.

The components C3, L1 and L2 are individually optional and may be used in any combination. For example, L1 and L2 could be shorts and C3 could be omitted.

Figure 5A:
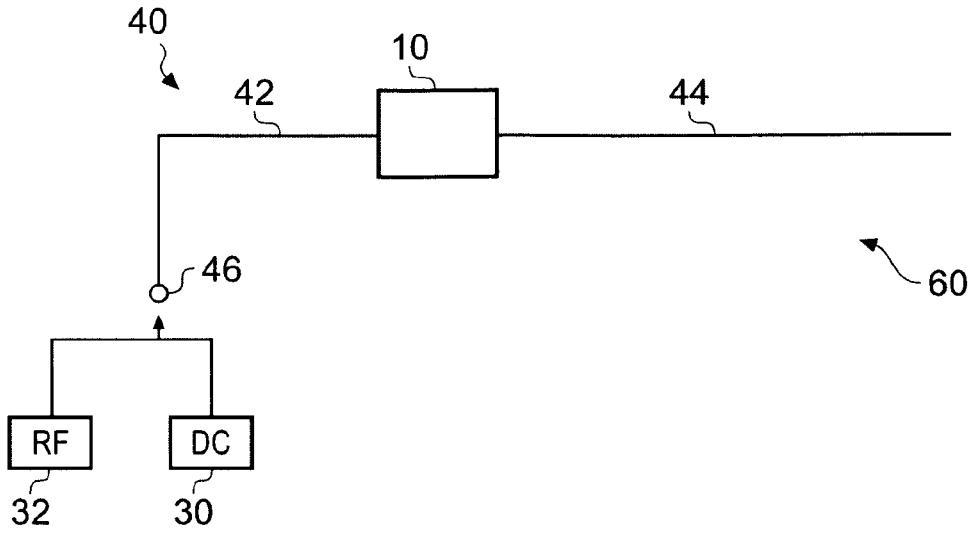
FIGS. 5A and 5B schematically illustrate apparatus comprising: an antenna arrangement and a single pole N-throw (SPNT) switch arrangement.

FIG. 5A schematically illustrates an apparatus 60 comprising: an antenna arrangement 40 comprising a first part 42 and a second part 44 that are interconnected via a SPNT switch arrangement 10. The antenna arrangement has a feed 46 connected to the first part 42.

Suitable SPNT switch arrangements 10 have been described previously. A dc offset may be provided to the feed 46 by the power source 30 and a radio frequency signal may be provided by the RF circuitry 32 to the feed 46.

The SPNT switch arrangement 10 is used to connect or isolate the first part 42 and the second part 44.

When isolation occurs, the first part 42 forms a first antenna element that is driven by the feed 46. This first antenna element has a first electrical impedance and a first resonant frequency.

When the first part 42 and the second part 44 are connected via the switch arrangement 10 they form a second antenna element that is driven by the feed 46. This second antenna element has a second electrical impedance that is different to the first electrical impedance and the second antenna element has a second resonant frequency that is different to the first resonant frequency.

The dc bias provided by the power source 30 to the SPNT switch arrangement 10 can thus be used to toggle the antenna arrangement's resonant frequency between the first resonant frequency and the second resonant frequency.

Figure 5B:
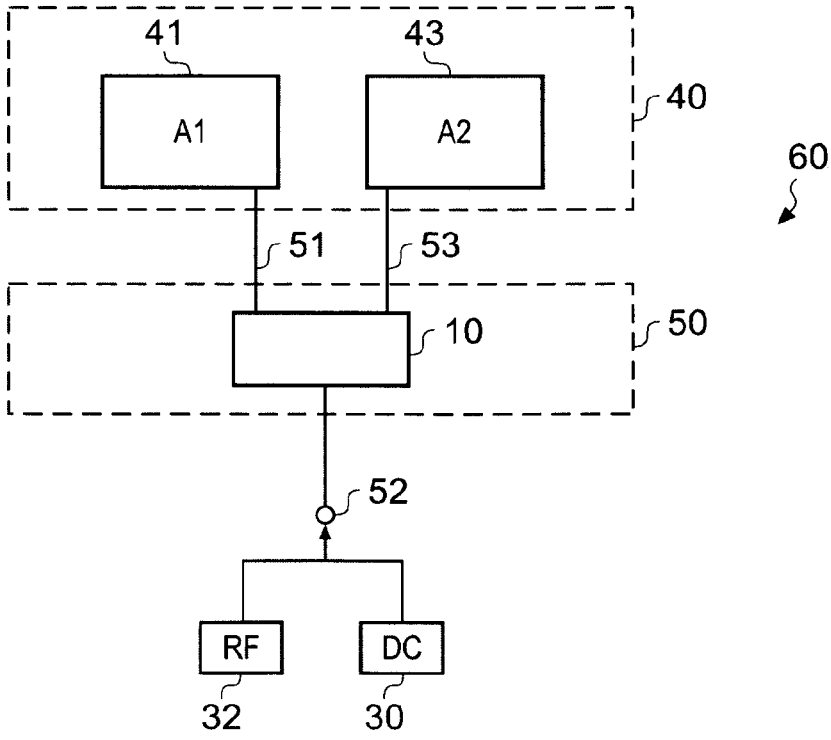

FIG. 5B schematically illustrates an apparatus 60 comprising: an antenna arrangement 40 comprising a first antenna element 41 and a separate second antenna element 43; a feed arrangement 50 for providing a RF signal to either the first antenna element 41 via a first feed 51 or the second antenna element 43 via a second feed 53.

The first antenna element 41 has a first impedance and it resonates at a first resonant frequency.

The second antenna element 42 has a second impedance and it resonates at a second resonant frequency that is different to the first resonant frequency.

The feed arrangement has an input node 52. A dc offset may be provided to the input node 52 by the power source 30 and a radio frequency signal may be provided by the RF circuitry 32 to the node 52.

The feed arrangement comprises a SPNT switch arrangement 10. The first and second feeds 51, 53 are connected to respective throws of the SPNT switch arrangement 10. The input node 52 is connected to a pole of the SPNT switch arrangement 10. Suitable SPNT switch arrangements 10 have been described previously.

The SPNT switch arrangement 10, under control of the dc bias, is used to connect either the first antenna element 41 or the second antenna element 43 to the RF circuitry 32.

Figure 6:
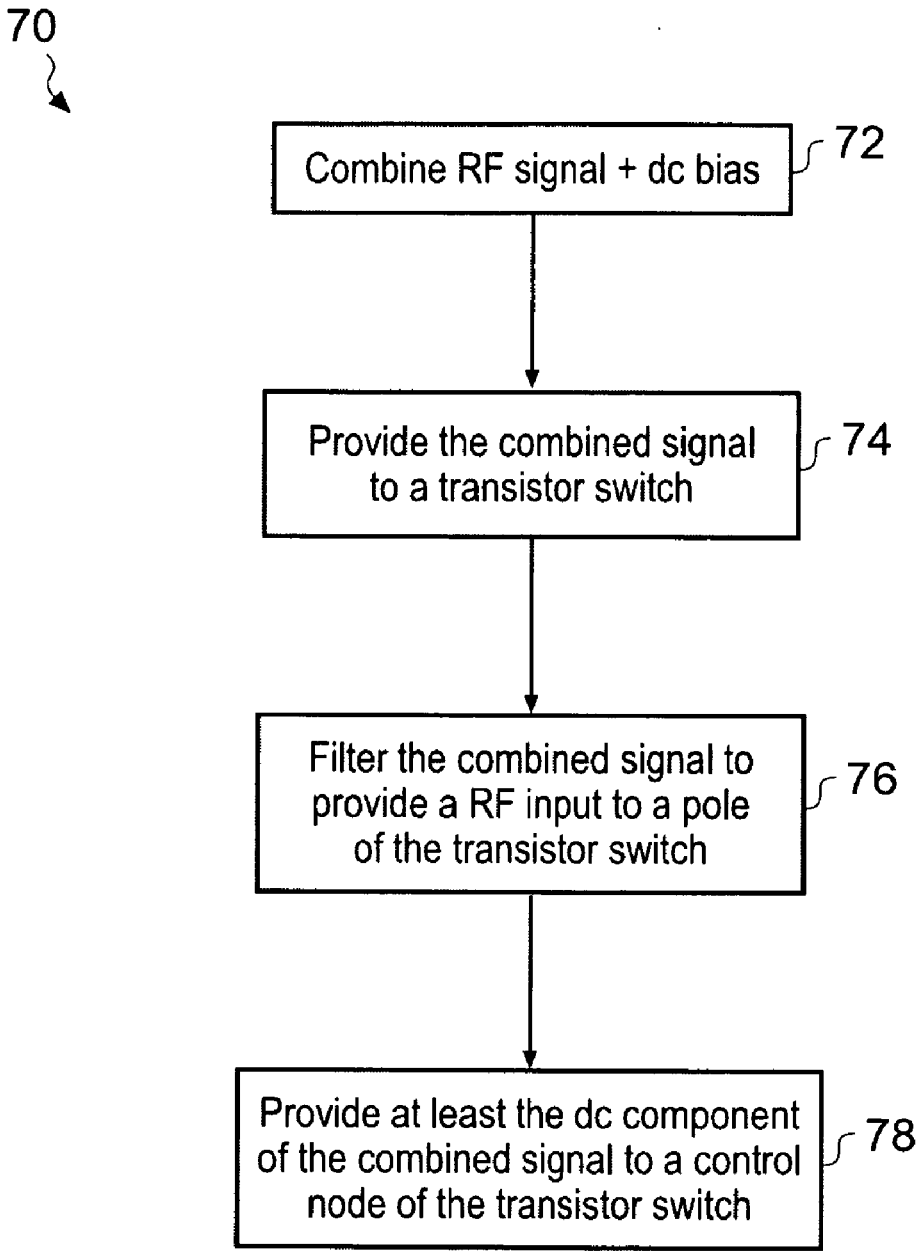
FIG. 6 schematically illustrates a method for controlling a switching arrangement.

FIG. 6 schematically illustrates a method 70 for controlling a switching arrangement 10.

At block 72, an RF signal 33 and a dc signal 31 are combined to form a combined signal 35.

Next, at block 74, the combined signal 35 is provided to the switch arrangement 10.

At block 76, the combined signal 35 is filtered, using capacitor C2, to recover the RF signal 33 for input to the pole 12 of the switch 10.

At block 78, at least the dc component of the combined signal 35 is provided to the control node 13 as the switch actuation signal X1.

The blocks illustrated in the Fig may represent steps in a method. The illustration of a particular order to the blocks does not necessarily imply that there is a required or preferred order for the blocks and the order and arrangement of the block may be varied.

In the embodiments described above, a first dc bias is applied to switch the transistor switch mechanism off and a second dc bias is applied to switch the transistor switch mechanism on. The values of the first and second dc bias depend upon the design of the transistors used in the switch mechanism and variation of the transistor design, particularly the threshold voltage, will change the first and second dc biases. The relative magnitudes of the first and second dc bias depend upon the design of the transistors used in the switch mechanism and variation of the transistor type from between enhancement type and depletion type will determine whether a larger bias is applied to switch on or switch off.

Although embodiments of the present invention have been described in the preceding paragraphs with reference to various examples, it should be appreciated that modifications to the examples given can be made without departing from the scope of the invention as claimed. For example, a SPNT switch may be used to connect together two distinct printing wiring boards (PWB). For example, although various embodiments of the invention has been described with reference to a SPNT switch other embodiments of the invention find application in other types of switch arrangements.

Features described in the preceding description may be used in combinations other than the combinations explicitly described.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

We claim:

1. An apparatus comprising:

a single pole N throw (SPNT) switch arrangement comprising a pole, two or more throw nodes and a switch mechanism arranged to connect the pole and a first throw node in response to a first signal and to connect the pole and a second throw node in response to a second signal, wherein the pole is arranged to receive an input signal; and an antenna arrangement comprising a first antenna element and a second antenna element, wherein the first antenna element is connected to the first throw node and the second antenna element is connected to the second throw node, wherein the first antenna element is separate from the second antenna element, wherein the first antenna element has a first resonant frequency and the second antenna element has a second resonant frequency different from the first resonant frequency.

2. An apparatus as claimed in claim 1, further comprising: a dc power source arranged to control a dc bias to provide the first signal.

3. An apparatus as claimed in claim 2, further comprising a dc filter positioned between the dc power source and the switch mechanism.

4. An apparatus as claimed in claim 3, further comprising: an interconnect, for providing the first signal, arranged for connection to the pole when providing the first signal, wherein the interconnect is series connected to the first throw node via the dc filter.

5. An apparatus as claimed in claim 3, further comprising: an interconnect, for providing the first signal, arranged for connection to the pole when providing the first signal, wherein the interconnect is series connected to the pole via the dc filter.

6. An apparatus as claimed in claim 5, wherein the second throw node is open circuit.

7. An apparatus as claimed in claim 1, further comprising: a first interconnect, for providing the first signal, arranged for connection to the pole when providing the first signal and a second interconnect, for providing the second signal, arranged for connection to the pole when providing the second signal.

8. An apparatus as claimed in claim 7, further comprising: a first dc power source arranged to control a first dc bias applied to the first interconnect to provide the first signal and a second dc power source arranged to control a second dc bias applied to the second interconnect to provide the second signal.

9. An apparatus as claimed in claim 8, further comprising: a first dc filter positioned between the first dc power source and the SPNT switch arrangement and a second dc filter positioned between the second dc power source and the switch mechanism.

10. An apparatus as claimed in claim 7, wherein the second interconnect is series connected to the pole via the second dc filter.

11. An apparatus as claimed in claim 7, wherein the second interconnect is series connected to the first throw node via the second dc filter.

12. An apparatus as claimed in claim 7 further comprising a first control node for receiving the first signal and a second control node for receiving the second signal, wherein the first interconnect is connected to the first control node and the second interconnect is connected to the second control node.

13. An apparatus as claimed in claim 12, further comprising one or more of: an inductor within the first interconnect; a capacitor connected between the first control node and the second control node; and an inductor within the second interconnect.

14. An apparatus as claimed in claim 1, further comprising: an interconnect, for providing the first signal, arranged for connection to the pole when providing the first signal.

15. An apparatus as claimed in claim 14, further comprising: a first control node for receiving the first signal and a second control node for receiving the second signal, wherein the interconnect is connected to at least the first control node.

16. An apparatus as claimed in claim 1, wherein the switch mechanism is a transistor switch element or a transconductance switch element.

17. An apparatus as claimed in claim 1, wherein the first and second signals toggle an electrical impedance of the antenna arrangement between a first impedance and a second impedance.

18. An apparatus as claimed in claim 1, wherein the switch mechanism is arranged to disconnect the pole and the first throw node in response to the second signal and to disconnect the pole and the second throw node in response to the first signal.

19. An apparatus as claimed in claim 1, wherein the first signal enables use of a first feed for the antenna arrangement and the second signal enables use of a second feed for the antenna arrangement.

20. An apparatus as claimed in claim 19, wherein the first feed is used to enable resonance of the first antenna element at the first resonant frequency and wherein the second feed is used to enable resonance of the second antenna element at the second resonant frequency that is different to the first resonant frequency.

21. An apparatus as claimed in claim 1, further comprising: radio frequency (RF) circuitry arranged to provide a radio frequency (RF) signal to the SPNT switch arrangement.

22. An apparatus as claimed in claim 21, wherein the input signal comprises one of: the RF signal, a combination of the RF signal and the first signal or a combination of the RF signal and the second signal.

23. An apparatus as claimed in claim 1, further comprising: a dc bias source for providing a dc bias signal; and radio frequency (RF) circuitry for providing an RF signal, wherein the SPNT switch arrangement further comprises a transistor arranged to have a channel connecting the pole and the first throw node and a gate connected to receive the dc bias signal, wherein the transistor channel is arranged to provide the RF signal to the antenna arrangement when the dc bias signal is provided by the dc bias source.

24. A method comprising:

combining a radio frequency (RF) signal and a dc signal;

providing the combined signal at a transistor switch having at least a pole for receiving an input signal, a control node for receiving a switch actuation signal, a first throw node for providing an output signal to a first antenna element having a first resonant frequency and a second throw node for providing an output signal to a second antenna element separate from the first antenna element and having a second resonant frequency different from the first resonant frequency;

providing at least the dc component of the combined signal to the control node as the switch actuation signal; and filtering the combined signal at the pole or the throw node to remove the dc signal.

25. An apparatus comprising:

a single pole N throw (SPNT) switch arrangement comprising a pole, one or more throw nodes and a switch mechanism arranged to connect the pole and a first throw node in response to a first signal and to disconnect the pole and the first throw node in response to a second signal, wherein the pole is arranged to receive an input signal; and an antenna arrangement comprising a first antenna part and a second antenna part, wherein the first antenna part is connected to the pole and the second antenna part is connected to the first throw node, wherein the first antenna part is separate from the second antenna part, wherein for a case where the second signal is present the first antenna part forms a first antenna element having a first resonant frequency, wherein for a case where the first signal is present the first antenna part and the second antenna part form a second antenna element having a second resonant frequency different from the first resonant frequency.

26. An apparatus as claimed in claim 25, further comprising: a dc power source arranged to control a dc bias to provide the first signal.

27. An apparatus as claimed in claim 26, further comprising: an interconnect, for providing the first signal, arranged for connection to the pole when providing the first signal, wherein the interconnect is series connected via the dc filter to the pole or to the first throw node.

28. An apparatus as claimed in claim 25, further comprising: an interconnect, for providing the first signal, arranged for connection to the pole when providing the first signal.

29. An apparatus as claimed in claim 25, further comprising: radio frequency (RF) circuitry arranged to provide a radio frequency (RF) signal to the SPNT switch arrangement.

30. An apparatus as claimed in claim 25, wherein the input signal comprises one of: the RF signal, a combination of the RF signal and the first signal or a combination of the RF signal and the second signal.

* * * * *